US005715624A

United States Patent [19]

Hilbelink et al.

[11] Patent Number: 5,715,624

[45] Date of Patent: Feb. 10, 1998

[54] SHOOTING AID AND SUPPORT FOR A PISTOL

[76] Inventors: Glen P. Hilbelink, deceased, late of Sheboygan, Wis.; by Mary S. Hilbelink, executrix, 6713 S. Business Dr., Sheboygan, Wis. 53081

[21] Appl. No.: 538,901

[22] Filed: Oct. 4, 1995

[51] Int. Cl.[6] ..... F41A 9/62; F41A 29/00; F41A 31/00

[52] U.S. Cl. ..... 42/94

[58] Field of Search ..... 42/94, 100; 33/233; 89/40.06

[56] References Cited

U.S. PATENT DOCUMENTS

| | | | |
|---|---|---|---|
| 1,184,078 | 5/1916 | Cooke | 42/94 |
| 4,007,554 | 2/1977 | Helmstadter | 42/94 |
| 4,026,057 | 5/1977 | Cady | 42/94 |
| 4,438,581 | 3/1984 | LaValle | 42/94 |
| 4,854,066 | 8/1989 | Canterbury, Sr. | 42/94 |
| 4,858,359 | 8/1989 | Danz | 42/94 |
| 5,070,636 | 12/1991 | Mueller | 42/94 |
| 5,081,783 | 1/1992 | Jarvis | 42/94 |
| 5,375,337 | 12/1994 | Butler | 33/506 |
| 5,410,835 | 5/1995 | Vetter | 42/94 |
| 5,497,575 | 3/1996 | Fried | 42/94 |

*Primary Examiner*—Charles T. Jordan
*Assistant Examiner*—Meena Chelliah
*Attorney, Agent, or Firm*—Breiner & Breiner

[57] ABSTRACT

A shooting stick for supporting a hand-held pistol, includes a post, one end of which is adapted to touch the ground, and the other end is adapted to support the barrel of a pistol. The post is adjustable in length so that the height of the pistol-supporting end above the ground can be adjusted to accommodate the stature of the user of the pistol. A shelf is slidably supported near the upper end of the post in such a way that the butt of a pistol resting on the shelf can be properly positioned in the upper-supporting end of the post. The shelf is pivotally connected to the sliding support, and the post can consist of two pieces slidably interconnected so that the arrangement of shelf and the post parts can be collapsed so as to occupy a minimum space.

3 Claims, 1 Drawing Sheet

SHOOTING AID AND SUPPORT FOR A PISTOL

BACKGROUND OF THE INVENTION

Shooting sticks or shooting aids for sports hunting or game hunting in the field have long been known and the history of such items go back to the Middle Ages when a bipod was used to support a blunderbluss and certainly more recently in England for game shooting in the field.

Most of these shooting aids or supports for the firearm relates to rifles, but in order to get the most meaningful results with precision shooting of a rifle or handgun, it should be supported from a rest of some sort.

Many sportsmen are strong enough and stable and sturdy enough to shoot accurately without a support or shooting aid, but short of clamping the firearm in some kind of mechanical fixture, shooting from a comfortable, rested position is required and in the field some sort of aid or support is highly desirable.

The most frequently used shooting aid is the rifle sling or carrying strap. In addition, a straight stick, usually called a shooting stick but the crotch at the top unto which the barrel of the rifle can be placed, is most commonly used, but as useful as they are, a monopod is less stable than a bipod, and the stick is a monopod.

The bipod is much more effective, and they can be short for prone position shooting; somewhat longer for squat or sitting position, and even longer for a standing position.

All of these devices are well-known for people who are hunting or shooting with rifles, but very few supports have been designed or supplied for pistol shooting.

Some of the pistol bipods are mounted directly on the barrel of the gun and that is generally helpful for a person shooting from a prone position, but a support for a pistol being used by a person in a standing position should support not only the barrel of the gun, but also the handgrip.

SUMMARY OF THE INVENTION

To accomplish this end, the inventor has invented the pistol-support of the present invention which includes a 2-part extendable and adjustable support which can be placed on the ground and on the upper portion of which a barrel-supporting crotch is fashioned.

Below the barrel support is a bracket which is adjustable vertically along the length of the support and from which a platform is pivotally supported so that it can be swung horizontally outward and at right angles to the support at a distance below the crotch so that while the barrel of the pistol is supported in the crotch, the handgrip, hand and arm of the shooter can be properly supported at an elevation appropriate for the height of the person doing the shooting.

Therefore, an object of the present invention is to provide a shooting stick for a pistol which supports both the barrel and the handgrip of the gun.

Another object is to provide a shooting stick for a pistol which includes an arm rest and a gun rest, and both can be separably and selectively adjusted with respect to each other and with respect to the height from the ground on which the supporting stick is placed.

With the above and other objects in view, further information and a better understanding of the present invention may be achieved by referring to the following detailed description:

DESCRIPTION OF THE PREFERRED EMBODIMENT

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

DESCRIPTION OF THE PREFERRED EMBODIMENT

Figure 1:
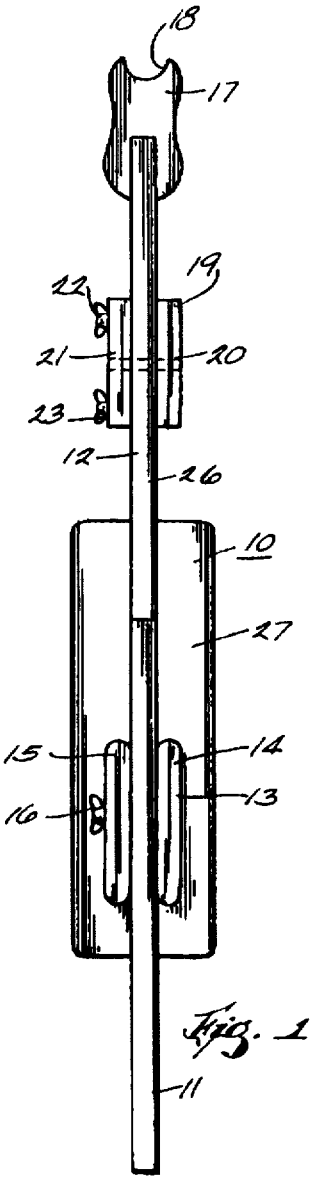
FIG. 1 is a front elevational view.
Figure 3:
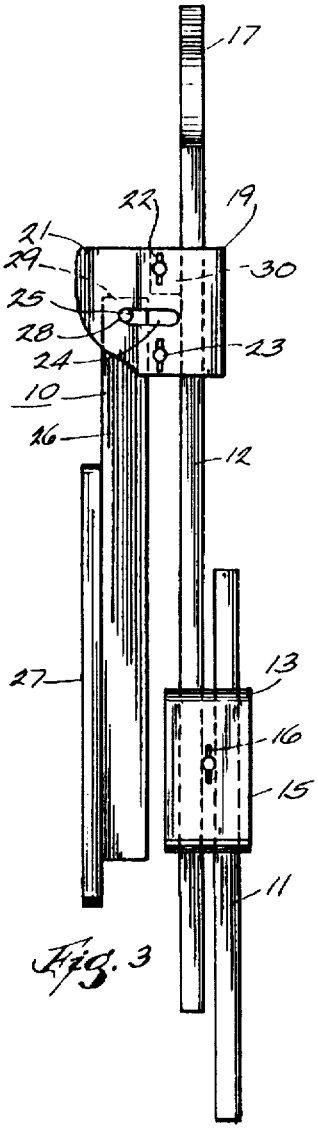
FIG. 3 is a right side elevational view.

Referring now to FIGS. 1 and 3, there is shown a shooting stick 10 which includes a lower vertical post 11 and an upper vertical post 12. These two posts are slidably interconnected by a clamp 13 which includes two blocks 14 and 15 connected by a thumbscrew 16 which, when tightened, holds the two vertical posts 11 and 12 in fixed position at whatever height and relationship the user chooses.

A slight turn of the thumbscrew 16 enables the two posts 11 and 12 to be slidably adjusted with respect to each other, and thus to change the elevation of the upper post 12 with respect to the ground on which the lower post 11 has been placed.

Figure 2:
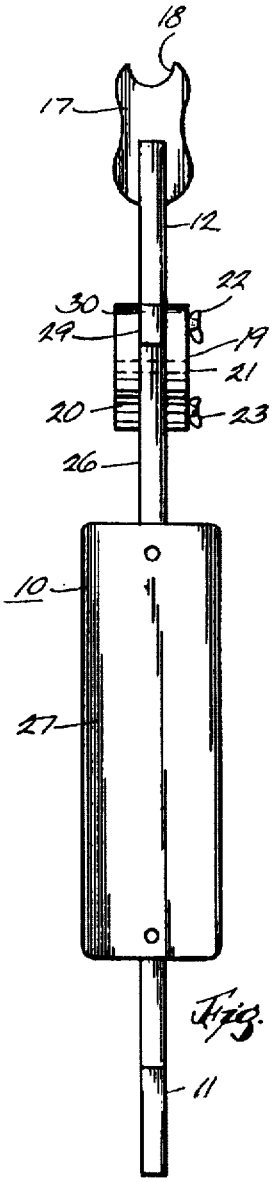
FIG. 2 is a rear elevational view.

At the top of the post 12 is a crotch portion 17 which, as can be seen particularly in FIGS. 1 and 2, provides a yoke portion 18 into which the barrel of a pistol can be rested.

Disposed slightly below the crotch 17 is another slidable bracket 19 which includes two portions 20 and 21 clamped together by the screws 22 and 23. The loosening or tightening of the screws 22 and 23 enable the bracket 19 to be moved upwardly or downwardly along the post 12 to a height chosen to be suitable by the user of the shooting stick, and the type of gun to be used.

Disposed in each of the brackets 20 and 21 are slots 24 through which a pin 25 extends and in which slots 24 the pin 25 may slide horizontally.

Also attached to the pin 25 is an arm 26 which supports a shelf 27 on which the forearm or wrist of the user of the shooting stick can rest when the arm 26 is pivoted upwardly about the pin 25 to a horizontal position. This is shown particularly in FIG. 4.

Figure 4:
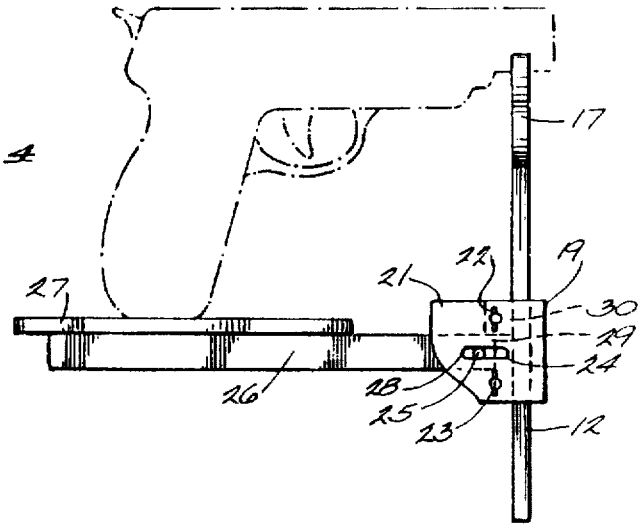
FIG. 4 is a right side elevational view with a tray extended.

It will be noted that in FIG. 3 the pin 25 is in its outermost position 28, but when the shelf 27 is raised to a horizontal position the arm 26 can be pushed horizontally toward the post 12 until the tongue 29 rests beneath a block 30 as shown in FIG. 4.

This locks the shelf 27 in a horizontal position so that the user of the shooting stick can rest firmly on it with the forearm and the butt of the pistol upon the shelf. The user can also adjust the vertical position of the shelf along the post 12 (by adjusting the screws 22 and 23) until the shelf 27 is at a suitable height below the crotch 17 so that the pistol which is being used at that time has its barrel in the yoke 18 and the butt on the shelf 27.

The shooting stick can be substantially collapsed by releasing the tension on the screw 16 and sliding the posts 11 and 12 generally together while also pulling the shelf 27 outwardly from beneath the block 30 so that the shelf may swing downwardly, parallel to the post 12 as is shown particularly in FIG. 3.

Thus I have provided a device which can be adapted to the size of the user and the type of the gun and which is particularly effective because it provides a support not only for the barrel of the pistol but also for the butt and the hand of the user as well.

Although I prefer the shooting aid of the present invention to be made of wood because it is warm to touch and beautiful to see, it is not critical what material is used. Furthermore, the lower portion of the post 11 may be bifurcated or branched (i.e., a bipod or a tripod), for increased stability.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. A shooting stick, i.e., support for a hand-held pistol including a post having a top end and a ground-contacting end, a first adjustable bracket slidably mounted on said post, a pistol-barrel-support at the top end of said post, and an arm pivotally mounted on said first bracket for engaging a butt of a pistol while the barrel of the pistol rests on said support, wherein said post includes two parts slidably connected to each other by a second bracket which enables changing distance as present between the ground-contacting end and the top end of the post; and said arm includes a tongue and said first bracket includes a stop which, when contacting said tongue, supports the arm in a horizontal position when said post is disposed vertically above the ground.

2. The shooting stick of claim 1 wherein said first bracket has a slot and said arm has a pin slidably disposed in said slot.

3. The shooting stick of claim 2 wherein said stick can be collapsed by sliding said two parts with respect to each other and by pivoting said arm about the pin.

* * * * *